US009526964B2

(12) United States Patent
Sampathkumaran

(10) Patent No.: US 9,526,964 B2
(45) Date of Patent: Dec. 27, 2016

(54) USING PRESSURE SIGNAL FROM RACKET TO ADVISE PLAYER

(71) Applicant: Sony Corporation, Tokyo (JP)

(72) Inventor: Sriram Sampathkumaran, San Diego, CA (US)

(73) Assignee: Sony Corporation, Tokyo (JP)

( * ) Notice: Subject to any disclaimer, the term of this patent is extended or adjusted under 35 U.S.C. 154(b) by 345 days.

(21) Appl. No.: 14/269,681

(22) Filed: May 5, 2014

(65) Prior Publication Data

US 2015/0314165 A1 Nov. 5, 2015

(51) Int. Cl.

| | |
|---|---|
| ***A63B 49/00*** | (2015.01) |
| ***A63B 69/38*** | (2006.01) |
| ***A63B 24/00*** | (2006.01) |
| ***A63B 71/06*** | (2006.01) |

(52) U.S. Cl.

CPC ..... *A63B 69/38* (2013.01); *A63B 24/0006* (2013.01); *A63B 24/0062* (2013.01); *A63B 71/0622* (2013.01); *A63B 2024/0068* (2013.01); *A63B 2060/464* (2015.10); *A63B 2071/063* (2013.01); *A63B 2220/56* (2013.01); *A63B 2220/58* (2013.01); *A63B 2220/801* (2013.01); *A63B 2220/833* (2013.01); *A63B 2225/20* (2013.01); *A63B 2225/54* (2013.01)

(58) Field of Classification Search

None

See application file for complete search history.

(56) References Cited

U.S. PATENT DOCUMENTS

| | | | | |
|---|---|---|---|---|
| 5,059,944 | A | 10/1991 | Carmona | |
| 8,262,517 | B2 | 9/2012 | Balasubramanyan | |
| 8,465,376 | B2 | 6/2013 | Bentley | |
| 2003/0216228 | A1 | 11/2003 | Rast | |
| 2005/0239583 | A1 | 10/2005 | Damen et al. | |
| 2007/0197938 | A1 | 8/2007 | Tyson et al. | |
| 2008/0174550 | A1 | 7/2008 | Laurila et al. | |
| 2009/0029754 | A1 | 1/2009 | Slocum et al. | |
| 2010/0081116 | A1* | 4/2010 | Barasch | A63B 24/0003 434/252 |
| 2010/0281432 | A1* | 11/2010 | Geisner | G06F 3/011 715/849 |
| 2011/0183787 | A1* | 7/2011 | Schwenger | A63B 49/00 473/553 |
| 2011/0230273 | A1 | 9/2011 | Niegowski et al. | |
| 2011/0230274 | A1 | 9/2011 | Lafortune et al. | |
| 2011/0230985 | A1 | 9/2011 | Niegowski et al. | |
| 2011/0230986 | A1 | 9/2011 | Lafortune et al. | |
| 2012/0004055 | A1 | 1/2012 | Balasubramanyan | |
| 2012/0028047 | A1 | 2/2012 | Imai et al. | |
| 2012/0052971 | A1 | 3/2012 | Bentley | |
| 2012/0052972 | A1 | 3/2012 | Bentley | |

(Continued)

OTHER PUBLICATIONS

Sriram Sampanthkumaran, "Combining Signal Information From Shoes and Sports Racket" related U.S. Appl. No. 14/269,499, non-final office action dated Jan. 5, 2016.

(Continued)

*Primary Examiner* — Jason Yen

(74) *Attorney, Agent, or Firm* — John L. Rogitz

(57) ABSTRACT

Methods and apparatus are disclosed for comparing signals from pressure sensors under the grip of a tennis racket to digital templates to gain insight into the player's grip, e.g., during ball striking moments.

18 Claims, 2 Drawing Sheets

(56) References Cited

U.S. PATENT DOCUMENTS

| | | | | |
|---|---|---|---|---|
| 2012/0190505 | A1* | 7/2012 | Shavit | A63B 71/0622 482/8 |
| 2013/0066588 | A1 | 3/2013 | Sherry | |
| 2013/0071815 | A1* | 3/2013 | Hudson | F41G 3/26 434/19 |
| 2013/0211774 | A1 | 8/2013 | Bentley et al. | |
| 2013/0274040 | A1 | 10/2013 | Coza et al. | |

OTHER PUBLICATIONS

Sriram Sampanthkumaran, "Combining Signal Information From Shoes and Sports Racket" related U.S. Appl. No. 14/269,499, applicants response to non-final office action filed Jan. 7, 2016.

Sriram Sampathkumaran, "Combining Signal Information from Shoes and Sports Racket", file history of related pending U.S. Appl. No. 14/269,499 filed May 5, 2014.

Sriram Sampathkumaran, "Combining Signal Information from Shoes and Sports Racket", related pending U.S. Appl. No. 14/269,499, final office action dated Jun. 17, 2016.

Sriram Sampathkumaran, "Combining Signal Information from Shoes and Sports Racket", related pending U.S. Appl. No. 14/269,499, applicant response to final office action filed Jun. 17, 2016.

* cited by examiner

USING PRESSURE SIGNAL FROM RACKET TO ADVISE PLAYER

I. FIELD OF THE INVENTION

The present application relates generally to using pressure signals from a racket such as a tennis racket to give a player insights into his or her play.

II. BACKGROUND OF THE INVENTION

A computer ecosystem, or digital ecosystem, is an adaptive and distributed socio-technical system that is characterized by its sustainability, self-organization, and scalability. Inspired by environmental ecosystems, which consist of biotic and abiotic components that interact through nutrient cycles and energy flows, complete computer ecosystems consist of hardware, software, and services that in some cases may be provided by one company, such as Sony. The goal of each computer ecosystem is to provide consumers with everything that may be desired, at least in part services and/or software that may be exchanged via the Internet. Moreover, interconnectedness and sharing among elements of an ecosystem, such as applications within a computing cloud, provides consumers with increased capability to organize and access data and presents itself as the future characteristic of efficient integrative ecosystems.

Two general types of computer ecosystems exist vertical and horizontal computer ecosystems. In the vertical approach, virtually all aspects of the ecosystem are owned and controlled by one company, and are specifically designed to seamlessly interact with one another. Horizontal ecosystems, one the other hand, integrate aspects such as hardware and software that are created by other entities into one unified ecosystem. The horizontal approach allows for greater variety of input from consumers and manufactures, increasing the capacity for novel innovations and adaptations to changing demands.

Present principles are directed to specific aspects of computer ecosystems, specifically, to permitting tennis players who are engrossed in their game during play to later correlate errors and advantages in their play to advantageously gain insight into strengths and weaknesses of their game.

SUMMARY OF THE INVENTION

Accordingly, a device includes at least one computer readable storage medium bearing instructions executable by a processor, and at least one processor configured for accessing the computer readable storage medium to execute the instructions to configure the processor for receiving signals from at least one sensor on a handle of a sports racket and comparing the signals to plural electronic templates. The instructions when executed by the processor configure the processor for, based on the comparing, determining at least one match between the signals and at least a first template, and presenting first output to a person. The first output is correlated to the first template.

In some embodiments, the instructions when executed by the processor configure the processor for, based on the comparing, determining at least one match between the signals and at least a second template, and presenting second output to a person. The second output is correlated to the second template. The first and second outputs may include qualitative comments related to a player's grip on the handle, and may be audible and/or visual.

In a non-limiting example, plural sensors are provided on a mat engaged with the handle. The sensors can be contact sensors.

In another aspect, a method includes receiving signals from a sports racket representing a grip pattern of a player wielding the racket. The method also includes evaluating the signals, and based at least in part on the evaluating, outputting a grip characteristic.

In another aspect, a system includes at least one racket such as a tennis racket and at least one sensor on a handle of the racket under a grip thereof and configured for generating signals. At least one computing device is configured for receiving the signals and outputting an indication based thereon.

The details of the present invention, both as to its structure and operation, can be best understood in reference to the accompanying drawings, in which like reference numerals refer to like parts, and in which:

DETAILED DESCRIPTION OF THE PREFERRED EMBODIMENT

Figure 1:
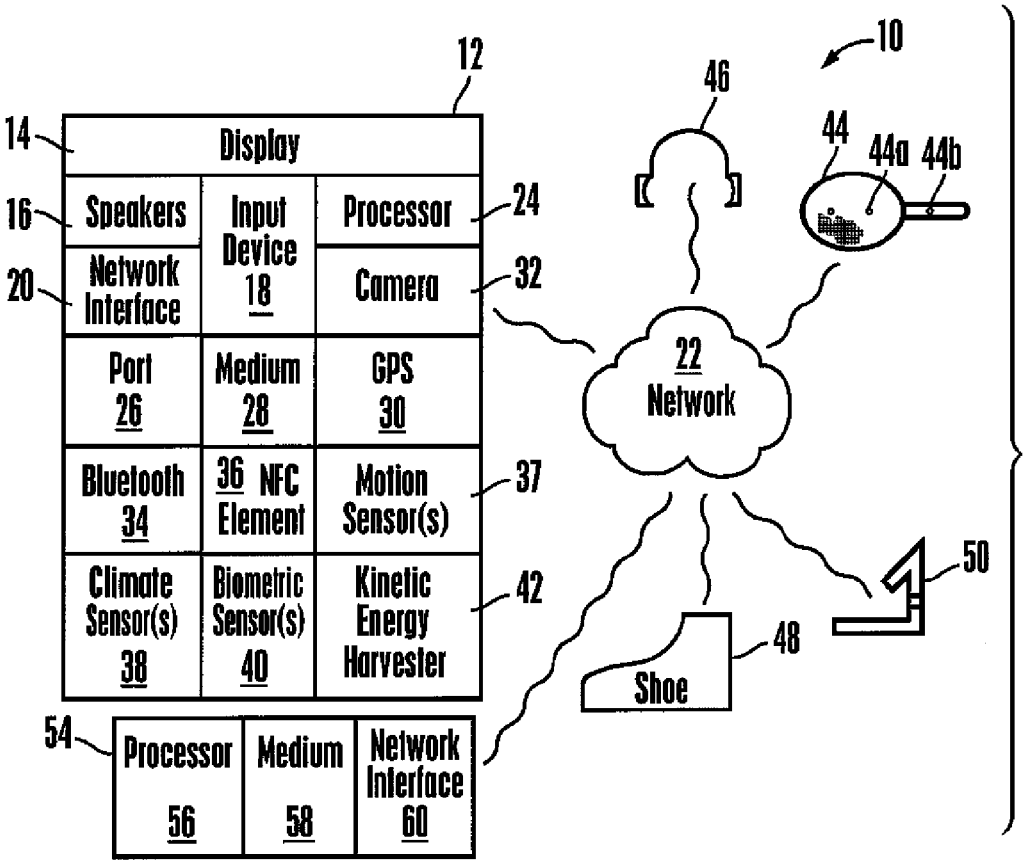
FIG. 1 is a block diagram of an example system including an example in accordance with present principles.

As set forth further below, pressure distribution is obtained between the hand(s) of a player and the handle of a racket such as a tennis racket and analyzed for presenting useful information to the player.

Accordingly, in general this disclosure relates generally to computer ecosystems including aspects of consumer electronics (CE) device based user information in computer ecosystems. A system herein may include server and client components, connected over a network such that data may be exchanged between the client and server components. The client components may include one or more computing devices including portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online-social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires. Such connections may include wireless communication connections including infrared and radio.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12 that may be waterproof (e.g., for use while swimming). The CE device 12 may be, e.g., a computerized Internet enabled ("smart") telephone, a tablet computer, an Pod, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is configured to undertake present principles (e.g. communicate with other CE devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, one or more speakers 16 for outputting audio in accordance with present principles, and at least one additional input device 18 such as e.g. an audio receiver/microphone for e.g. entering audible commands to the CE device 12 to control the CE device 12. The example CE device 12 may also include one or more network interfaces 20 for communication over at least one network 22 such as the Internet, an WAN, an LAN, etc. under control of one or more processors 24. It is to be understood that the processor 24 controls the CE device 12 to undertake present principles, including the other elements of the CE device 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, WiFi transceiver, etc.

In addition to the foregoing, the CE device 12 may also include one or more input ports 26 such as, e.g., a USB port to physically connect (e.g. using a wired connection) to another CE device and/or a headphone port to connect headphones to the CE device 12 for presentation of audio from the CE device 12 to a user through the headphones. The CE device 12 may further include one or more tangible computer readable storage medium 28 such as disk-based or solid state storage, it being understood that the computer readable storage medium 28 may not be a carrier wave. Also in some embodiments, the CE device 12 can include a position or location receiver such as but not limited to a GPS receiver and/or altimeter 30 that is configured to e.g. receive geographic position information from at least one satellite and provide the information to the processor 24 and/or determine an altitude at which the CE device 12 is disposed in conjunction with the processor 24. However, it is to be understood that that another suitable position receiver other than a GPS receiver and/or altimeter may be used in accordance with present principles to e.g. determine the location of the CE device 12 in e.g. all three dimensions.

Continuing the description of the CE device 12, in some embodiments the CE device 12 may include one or more cameras 32 that may be, e.g., a thermal imaging camera, a digital camera such as a webcam, and/or a camera integrated into the CE device 12 and controllable by the processor 24 to gather pictures/images and/or video in accordance with present principles. Also included on the CE device 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the CE device 12 may include one or more motion sensors 37 (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input to the processor 24. The CE device 12 may include still other sensors such as e.g. one or more climate sensors 38 (e.g. barometers, humidity sensors, wind sensors, light sensors, temperature sensors, etc.) and/or one or more biometric sensors 40 providing input to the processor 24. In addition to the foregoing, it is noted that in some embodiments the CE device 12 may also include a kinetic energy harvester 42 to e.g. charge a battery (not shown) powering the CE device 12.

Still referring to FIG. 1, in addition to the CE device 12, the system 10 may include one or more other CE device types such as, but not limited to, a computerized tennis racket 44 with one or more strike sensors 44*a* to sense when the head contacts a tennis ball and one or more handle sensors 44*b* such as a pressure sensors embedded in a pressure-sensitive mat to sense a person's grip on the handle. A block diagram of additional components of the tennis racket 44 is shown and described below.

Also, computerized Internet-enabled headphones and/or ear buds 46 may be provided, as well as computerized Internet-enabled clothing 48 such as tennis shoes, an example of which is discussed further below. Moreover, a computerized Internet-enabled exercise machine 50 (e.g. a treadmill, exercise bike, elliptical machine, etc.), may be provided. It is to be understood that other CE devices included in the system 10 including those described in this paragraph may respectively include some or all of the various components described above in reference to the CE device 12 such but not limited to e.g. the biometric sensors and motion sensors described above, as well as the position receivers, cameras, input devices, and speakers also described above.

Now in reference to the afore-mentioned at least one server 54, it includes at least one processor 56, at least one tangible computer readable storage medium 58 that may not be a carrier wave such as disk-based or solid state storage, and at least one network interface 60 that, under control of the processor 56, allows for communication with the other CE devices of FIG. 1 over the network 22, and indeed may facilitate communication between servers and client devices in accordance with present principles. Note that the network interface 60 may be, e.g., a wired or wireless modem or router, WiFi transceiver, or other appropriate interface such as, e.g., a wireless telephony transceiver.

Accordingly, in some embodiments the server 54 may be an Internet server, may include and perform "cloud" functions such that the CE devices of the system 10 may access a "cloud" environment via the server 54 in example embodiments.

Figure 2:
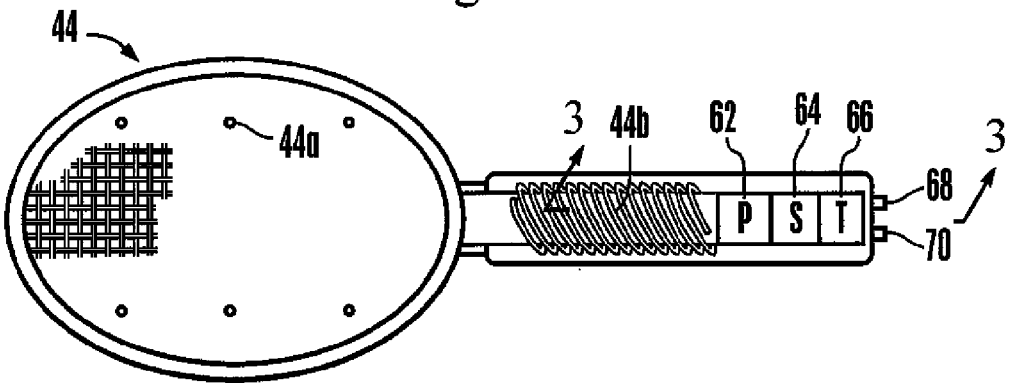
FIG. 2 is a schematic diagram of a tennis racket according to present principles.

Now referring to FIG. 2, a schematic view of a tennis racket 44 is shown which includes one or more strike sensors 44*a* and one or more handle sensors 44*b*. Although the strike sensors 44*a* are shown on the head of the racket, e.g., on the frame of the head, in some embodiments the strike sensors 44*a* may be on the handle. In some embodiments the strike sensors 44*a* may be omitted and only the handle sensor 44*b* used according to description below. Without limitation, the various racket sensors may be implemented by accelerometers, gyroscopes, force sensing resistors, other pressure sensing devices, contact sensors, heat sensors, etc.

In some example non-limiting embodiments the handle sensor 44*b* may be implemented by a pressure-sensitive mat such as those described in, e.g., U.S. Pat. Nos. 7,785,704 and 5,033,291, incorporated herein by reference and configured to surround the handle of the tennis racket as shown, just beneath the typically leather or rubber grip of the handle. Or, pressure distribution technology from RoadRunner can be modified from shoes to the handle of a tennis racket. The sensors 44*a*, 44*b* communicate signals to a racket processor 62 accessing a computer storage medium 64 and wirelessly sending the signals through a wireless transceiver 66, processed as described below by the racket processor 62 or unprocessed for processing by a receiving processor.

If desired, in some implementations user interface control elements may be provided. For example, an on/off switch 68 may be provided on, for instance, the end of the handle as shown to activate and deactivate the handle sensors 44*b*. A toggle-type element 70 may be provided to communicate start/stop/pause signals with the racket processor 62 and/or external processor such as the CE device processor 24. It is to be understood that the control elements may be implemented in a touchpad with a full range of features such as tap, double tap, swipe, gestures, etc.

Figure 3:
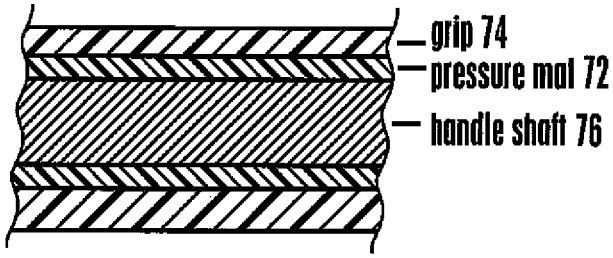
FIG. 3 is a cross-section of the racket handle as seen along the line 3-3 in FIG. 2.
Figure 4:
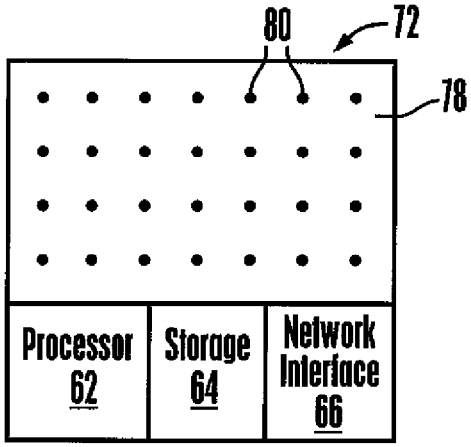
FIG. 4 is a plan view of an example pressure mat for sensing a player's grip on the handle of the tennis racket.

FIGS. 3 and 4 illustrate a non-limiting example of a pressure sensing assembly such as a mat 72 that may be interposed between an external grip 74 and a central elongated handle shaft 76 of the racket 44. As shown in FIG. 4, the mat 72 may include a thin flexible substrate 78 with plural contact sensors 80 such as pressure sensors embedded therein. The mat 72 may be wrapped around the shaft 76 and then covered by the grip 74. The sensors 80 communicate signals representing pressure or contact on the sensors 80 to the racket processor 62, which, like the storage 64 and network interface 66, may be engaged with the mat physically and/or through wires.

It will readily be appreciated that the signals from the sensors 80 establish a pattern based on the player's grip on the handle. With this understanding in mind, reference is now made to FIG. 5, in which at block 82 the pressure signals are received from the sensors 80. The racket processor may execute the ensuing logic or may transmit the signals to an external processor such as the CE device processor 24 and/or server processor 56 for processing of the signals as follows. At block 84, the pattern established by the signals is compared to a library of templates, and based on typically the closest match of a template during the comparison, an output is generated at block 86. The template most closely matching the grip pattern as indicated by the sensors 80, like the other templates against which the pressure signal pattern is compared, may be correlated in a data structure to a respective expert-derived indication.

Specifically, experts may pre-establish, using for example the racket 44 or similar racket during training, a plurality of grips (and concomitant pressure patterns) each of which is stored as a template and qualitatively annotated by the expert according to the expert's opinion of the particular grip. Among other qualitative indications that may be accorded to a particular template are whether the dimensions of the handle are suitable to the players hands, whether the type of grip the player is holding is generally good or generally poor, and where the player is holding the racket and whether that location is good or not. The template might also be annotated with comments regarding which hand is holding the racket and whether the player is using both hands. As play (and successive pressure patterns) progress, a succession of corresponding matching templates may establish a macro-pattern which itself may be pre-evaluated by an expert to evaluate, for a particular macro-pattern of matching templates, how the player's grip varies with time or during the game to detect fatigue or unnecessary constant pressure.

Figure 5:
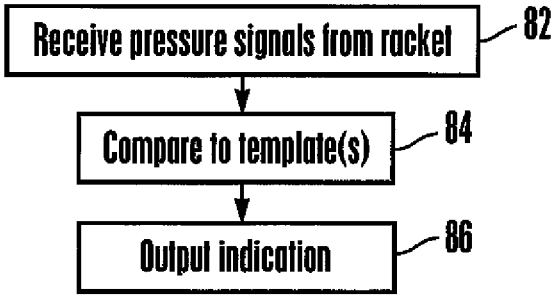
FIG. 5 is a flow chart of example logic according to present principles.
Figure 6:
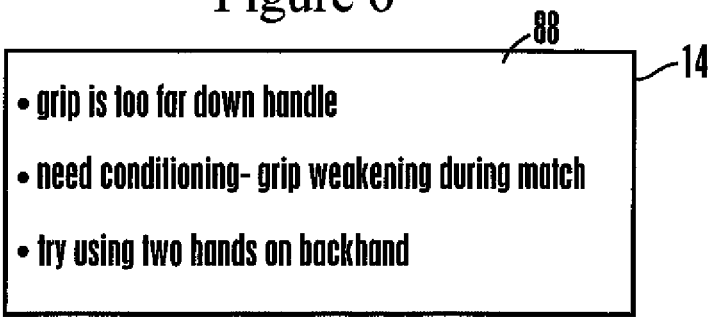
FIG. 6 is a screen shot of an example user interface according to present principles.

FIG. 6 illustrates an example non-limiting output generated at block 86 of FIG. 5. The CE device 12 may present on its display 14 various comments 88 as shown, responsive to which template most closely matched the pressure pattern of the player's grip. While visible output is shown, the output may be alternatively or additionally provided audibly, e.g., over the headphones 46. When presented audibly the output may be provided in near-real time during play, so that a player wearing the headphones as he plays can be given audible grip instructions during play.

While the particular USING PRESSURE SIGNAL FROM RACKET TO ADVISE PLAYER is herein shown and described in detail, it is to be understood that the subject matter which is encompassed by the present invention is limited only by the claims.

What is claimed is:

1. A device comprising:

at least one computer readable storage medium bearing instructions executable by a processor;

at least one processor configured for accessing the computer readable storage medium to execute the instructions to configure the processor for:

receiving signals from at least one sensor on a handle of a sports racket;

comparing data represented by the signals to plural electronic templates;

based on the comparing, determining at least one match with a first template; and presenting first human-perceptible output, the first output being correlated to the first template, wherein the templates are correlated in a data structure to respective expert opinions of respective grips represented by the respective templates, an expert opinion comprising at least one of: whether dimensions of the handle are suitable the output including the expert opinion associated with the first template.

2. The device of claim 1, wherein the instructions when executed by the processor configure the processor for:

based on the comparing, determining at least one match between the signals and at least a second template; and presenting second human-perceptible output, the second output being correlated to the second template.

3. The device of claim 2, wherein the first and second outputs include comments related to a player's grip on the handle.

4. The device of claim 1, wherein the first output is audible.

5. The device of claim 1, wherein the first output is visual.

6. The device of claim 1, wherein the at least one sensor includes plural sensors on a mat engaged with the handle.

7. The device of claim 1, wherein the sensors are contact sensors.

8. Method comprising:

receiving signals from a sports racket representing a grip pattern of a player wielding the racket;

evaluating the signals; and based at least in part on the evaluating, outputting a grip characteristic, wherein the evaluating includes:

comparing the signals to plural electronic templates;

based on the comparing, determining at least one match between the signals and at least a first template; and presenting first output, the first output being correlated to the first template and establishing the grip characteristic, wherein the templates are correlated in a data structure to respective expert opinions of respective grips represented by the respective templates, an expert opinion comprising at least one of: whether dimensions of the handle are suitable, the output including the expert opinion associated with the first template.

9. The method of claim 8, comprising:

based on the comparing, determining at least one match between the signals and at least a second template; and presenting second output, the second output being correlated to the second template and establishing the grip characteristic.

10. The method of claim 9, wherein the first and second outputs include comments related to a player's grip on the racket.

11. The method of claim 8, wherein the first output is audible.

12. The method of claim 8, wherein the first output is visual.

13. The method of claim 8, wherein the signals are generated by plural sensors on a mat engaged with the racket.

14. The method of claim 13, wherein the sensors are contact sensors.

15. System comprising:

at least one racket;

at least one sensor on a handle of the racket under a grip thereof and configured for generating signals; and at least one computing device configured for receiving the signals and outputting an indication based thereon, wherein the indication comprises an expert opinion comprising at least one of: whether dimensions of the handle are suitable.

16. The system of claim 15, comprising plural sensors embedded in a mat engaged with the handle under the grip.

17. The system of claim 15, wherein the sensor is a contact sensor.

18. The system of claim 17, wherein the contact sensor is a pressure sensor.

* * * * *